US010918177B1

(12) United States Patent
Peoples

(10) Patent No.: US 10,918,177 B1
(45) Date of Patent: Feb. 16, 2021

(54) ERGONOMIC OR USER-FRIENDLY DUAL WALKING CANE

(71) Applicant: Jerry A. Peoples, Harvest, AL (US)

(72) Inventor: Jerry A. Peoples, Harvest, AL (US)

( * ) Notice: Subject to any disclaimer, the term of this patent is extended or adjusted under 35 U.S.C. 154(b) by 0 days.

(21) Appl. No.: 16/852,013

(22) Filed: Apr. 17, 2020

(51) Int. Cl.
*A45B 9/00* (2006.01)
*A45B 7/00* (2006.01)
*A45B 9/02* (2006.01)

(52) U.S. Cl.
CPC ..... *A45B 9/00* (2013.01); *A45B 7/005* (2013.01); *A45B 9/02* (2013.01); *A45B 2009/005* (2013.01)

(58) Field of Classification Search
CPC ..... A45B 9/00; A45B 2009/005
See application file for complete search history.

(56) References Cited

U.S. PATENT DOCUMENTS

| | | | | |
|---|---|---|---|---|
| 432,759 A | | 7/1890 | Minniss | |
| 3,032,048 A | * | 5/1962 | Hoffmann | A61H 3/02 135/71 |
| 3,208,461 A | * | 9/1965 | Irwin | A61H 3/02 135/69 |
| 4,556,075 A | | 12/1985 | Hoffman | |
| 4,995,412 A | | 2/1991 | Hirn et al. | |
| 5,339,849 A | | 8/1994 | Stutz | |
| 5,361,793 A | | 11/1994 | Stahnke | |
| 6,206,019 B1 | | 3/2001 | Horvitz | |
| 7,007,704 B2 | | 3/2006 | Luckstead | |
| 7,637,273 B1 | | 12/2009 | Lisenby | |
| 7,992,583 B2 | * | 8/2011 | Lisenby | A45B 9/00 135/66 |
| 2003/0205266 A1 | * | 11/2003 | Luckstead | A45B 9/00 135/65 |
| 2005/0274404 A1 | * | 12/2005 | Bergman | A45B 7/00 135/65 |
| 2006/0090782 A1 | * | 5/2006 | Bergman | A45B 9/02 135/65 |
| 2017/0332748 A1 | * | 11/2017 | Kaplan | A45B 3/00 |

FOREIGN PATENT DOCUMENTS

| | | | | |
|---|---|---|---|---|
| CN | 102657416 A | | 9/2012 | |
| CN | 204016779 U | | 12/2014 | |
| FR | 2558694 A1 | * | 8/1985 | A45B 1/04 |

* cited by examiner

*Primary Examiner* — Noah Chandler Hawk
(74) *Attorney, Agent, or Firm* — Thomas J. Nikolai; DeWitt LLP

(57) ABSTRACT

A dual ergonomic walking cane system that is easy and comfortable to use employs an anterior and a posterior cane connected by at least one releasable coupling for use in one hand or following separation allowing the use of one cane in each hand with an optional ball grip on the anterior cane. A guide on one cane consists of a pair of spaced apart guide members extending from one cane toward the other cane for receiving the shaft of the other cane when inserted between them and then held in place by gravity, by an alignment coupling or by magnets. When handles located on each cane are moved apart the canes can be easily disengaged enabling the anterior cane to be quickly removed from the guide while the canes are at or close to horizontal alignment.

11 Claims, 4 Drawing Sheets

ERGONOMIC OR USER-FRIENDLY DUAL WALKING CANE

BACKGROUND OF THE INVENTION

The first application of a walking cane may well have been a stick employed by *Homo Erectus* a million years ago on the Serengeti plains of East Africa. Their usefulness has proven so effective that they have persisted down through the ages. The cane system. presented here provides a high degree of perfection in walking cane technology.

Walking canes fall into one of two broad categories; (1) the trekking type intended to enhance stability for mountain hiking treks and (2) a cane intended to relieve discomfort as a result of physical injury or arthritic deterioration of a joint. One fundamental motivation for a dual system is to overcome the limitations of a single cane. While several dual cane systems have been proposed, the use of two independence canes has been limited in the past because of an impracticality of accomplishing simple tasks such as egressing a doorway, fetching a newspaper or dealing with any simple task where a free hand is necessary. Previous approaches are represented by U.S. Pat. Nos. 7,007,704 and 4,556,075 which disclose canes joined by means of pins, latches, hooks, buttons, bands, Velcro and designs that mimic an archer's quiver or a sword sheath. U.S. Pat. No. 763,273 depends upon a somewhat complicated lever system joined by two gears to two cams for separating hook and loop fasteners that connect two canes. It also has been suggested that canes can be joined by machine bolts and wing nuts. All of these techniques have been dubbed as quick and easy. From the viewpoint of previous cane designers a few seconds or even a minute were apparently considered as quick since engaging a latch, turning a wing nut or drawing a cane from a. quiver device was considered as easy. However, from the viewpoint of a user who relies upon a dual system to be independent the terms "quick" and "easy" has a different connotation. Quick and easy implies something so quick and easy that transitioning appears normal to a bystander and feels normal. to the user. Otherwise, a few seconds of any awkwardness and/or clumsiness can seem equivalent to an eternity of embarrassment to a handicapped person.

In view of these and other deficiencies in the prior art it is one object of the present invention to avoid the awkwardness and inherent slow transitions that characterize the prior art and to facilitate user-friendly (ergonomic) operation.

It is another object of at least one embodiment of the invention to provide a dual cane system in which two canes are coupled together for use in one hand and held in place solely by the gravitational weight of the cane.

Another object of the invention is to provide a way to facilitate rejoining two canes together in which one of the canes is easily guided into place with respect to the other cane through a natural hand and wrist movement by the user.

Yet another object is to provide a duplex cane system of the type described in which the canes are self-aligning when being recoupled to one another.

Another object is to provide a dual walking cane system that lends itself to be formed from various material such as wood, plastic or metal yet enables the canes to be easily coupled and uncoupled from one another with little effort while remaining in substantial horizontal alignment with one another, i.e., without one cane having to be raised above the users head to allow them to be separated.

Still another object is to provide a guide operatively associated between the canes that has the ability to line up the one or more pairs of coupling connectors used for holding the canes together.

Another object is to provide an improved duplex cane system in which a handle of at least one of the canes can be either a ball handle or pistol-grip style handle.

Yet another object of the invention is to provide a duplex cane system in which at least one magnet is used to hold two canes in contact with one another while also assisting in bringing together a pair of self-aligning connector elements.

These and other more detailed and specific objects and advantages of the invention will be better understood by reference to the following figures and detailed description which illustrate preferred forms of the invention by way of these examples that are but a few of the various forms of the invention within the scope of the appended claims.

A brief analysis of how people walk is educative. While walking normally without a cane, two feet are simultaneously in contact with the ground about 20 percent of the time. Thus, 80 percent of the time only one foot is in contact with the ground. Walking stability results from the combination of foot-ground contact time while the brain orchestrates changes in body posture that best enhance stability. Body posture correction is an automatic brain function that takes place without conscious effort.

The application of a cane is equivalent to a third leg/foot because the brain can sense a force input transmitted through the cane to the body via hand and arm. With a cane in use there are always two contact points with the ground, and about 20 percent of the time there are three contact points with the ground. It is this additional distribution of foot-ground contact time that permits a single cane to sustain a greater level of stability while reliving joint discomfort.

It is also recognized that forces on leg joints may be unloaded by using the cane to support a portion of the body weight. Thus, the cane is also an instrument that can be used to relieve discomfort. The relationship between force and discomfort is non-linear. For example, a 20 percent decrease in joint force can relieve discomfort by 40 percent. However, 100 percent reduction in joint force will not relieve discomfort by 100 percent. There is also a cane manipulation factor. Force on a joint is best unloaded by leaning on the cane rather than deliberately pushing the cane. This principle may be demonstrated by standing in place while leaning on the cane rather than standing in place while pushing on the cane. Leaning on a cane produces a difference sensation than just pushing on a cane. Ultimately, the force created by leaning must be balanced by a force transmitted to the hand/arm, However, when the skill of leaning is achieved, the hand force is not produced by compulsion. Rather, the hand force is a natural consequence of leaning and it takes place subconsciously. A little practice is necessary to learn how to lean on the cane while walking rather than pushing on the cane while walking. The objective is to use the cane in a way to maximize user support while walking rather than the user supporting the cane.

Since a single cane does wonders to enhance walking stability while reliving discomfort, application of a dual cane system will demonstrate far superior performance over that of a single cane. A dual cane system will allow three points to always be in contact with the ground and during part of the walking cycle there will be four points in contact with the ground. There is a synergetic effect associated with these additional foot-ground contact points. Stability in walking can be enhanced by an order of magnitude and relief of discomfort can be substantial. The present invention amplifies the advantage of these characteristics. What may be impossible to negotiate with a single cane becomes possible with a dual system. The present dual cane system can eliminate the use of a walker and in some cases can replace a wheelchair. The present invention is also an excellent solution in cases where stability is a primary concern and discomfort is secondary. Most importantly, the present dual system allows the user to maintain his/her independence. One hallmark of the present invention is the friendliness (ergonomic benefit) it offers during transitioning between a single cane mode to a dual cane and back to a single cane.

BRIEF SUMMARY OF THE INVENTION

In accordance with the invention a walking cane system is provided that comprises a pair of canes which are adapted to function separately or connected to one another for use in one hand. Anterior and posterior canes each comprise an elongated shaft with upper and lower ends having a middle part between them and a handle at the upper end of each shaft. An upper coupling is provided in one preferred embodiment of the invention to secure the canes the together at or above the middle part of the cane system. There is a guide on at least one of the canes that can be formed from a pair of spaced apart guide members extending from one cane toward the other cane when the canes are connected. During use the guide is adapted to receive the shaft of the other cane which can be easily inserted into the guide by placing the shaft of one cane between the guide members such that the anterior and posterior canes can be brought toward one another to approach or achieve an aligned relationship and held together in one embodiment by the gravitational weight of the cane. In one form, the canes are constructed and arranged for being disconnected by manually separating the anterior cane handle from the posterior cane handle so that the upper coupling is disconnected and the shaft of the other cane is then free to move away from the guide such that the anterior and posterior canes are thereby able to be separated while in substantially horizontal alignment with one another in position to be used. The canes can then be used separately with one held in each hand of the user without manually raising one cane its entire length above the other. In this way a user-friendly walking cane system is provided that eliminates the clumsiness, embarrassment and awkwardness associated with prior dual cane systems.

BRIEF DESCRIPTION OF THE DRAWINGS

The foregoing features, objects and advantages of the invention will become apparent to those skilled in the art from the following detailed description of a preferred embodiment, especially when considered in conjunction with the accompanying drawings in which like numerals in the several views refer to corresponding parts.

DETAILED DESCRIPTION OF THE PREFERRED EMBODIMENTS

This description of the preferred embodiments is intended to be read in connection with the accompanying drawings, which are to be considered part of the entire written description of this invention. Terms such as "connected", "connecting", "attached", "attaching", "join" and "joining" are used interchangeably and refer to one structure or surface being secured to another structure or surface or integrally fabricated in one piece, unless expressively described otherwise.

Figure 1:
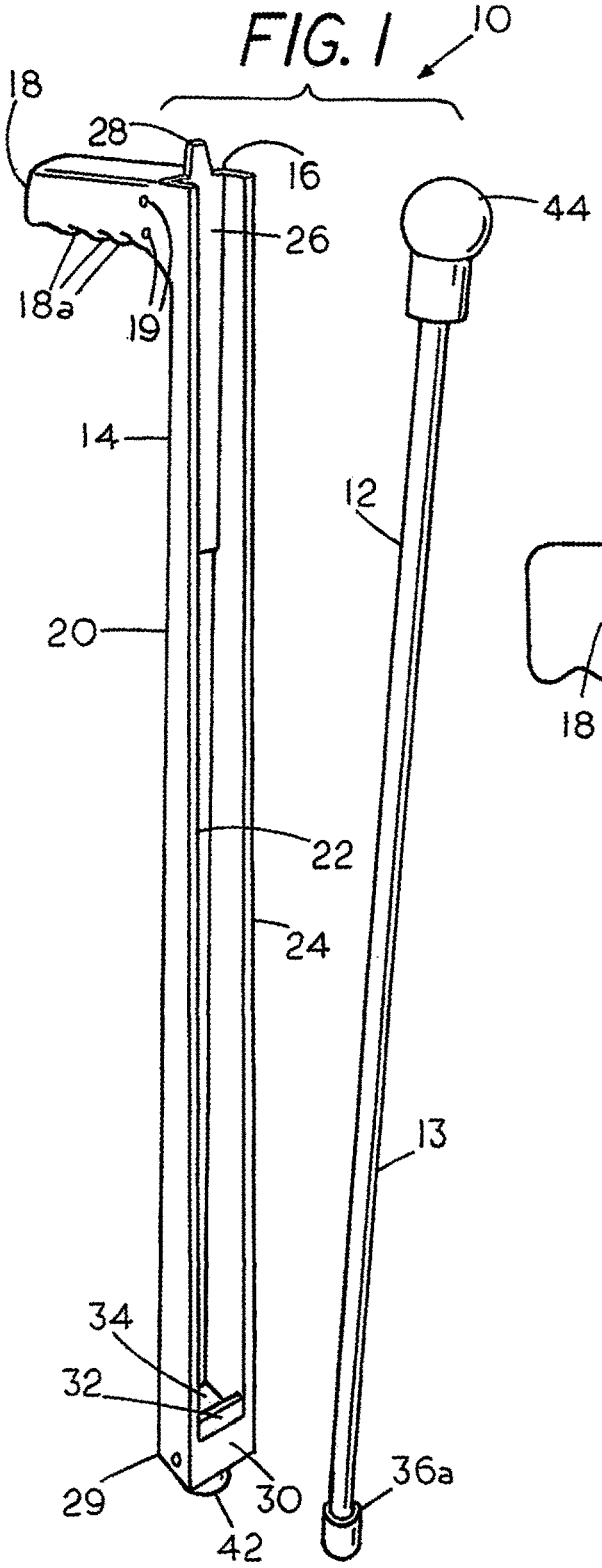
FIG. 1 is a perspective view of one preferred form of the invention with the canes separated for independent use.

Refer now to FIGS. 1-7 which illustrate the invention by way of example. The dual cane walking system indicated generally by the numeral 10 comprises an anterior cane 12 and a posterior cane 14 that are connected together for use in one hand as in FIG. 2 or can be separated from one another as shown in FIG. 1 for independent use with one cane in either hand.

Figure 2:
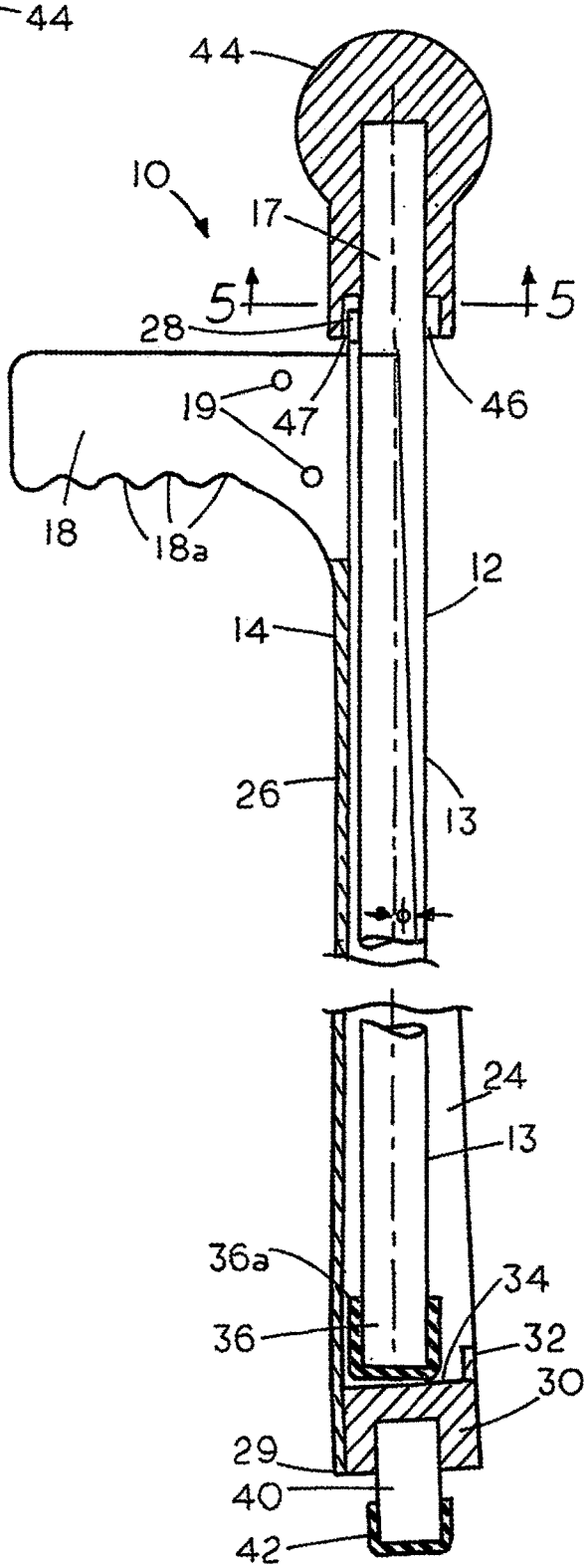
FIG. 2 is a side elevational view of the invention of FIG. 1 partly in section assembled for use in one hand.
Figure 3:
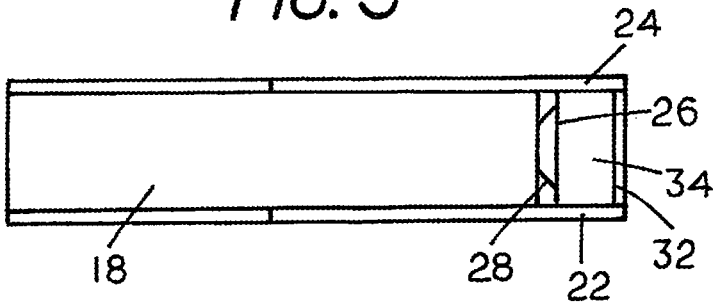
FIG. 3 is a top view of the left-hand cane of FIG. 1 on a larger scale.

At the top end 16 of the posterior cane is a rearwardly extending pistol grip style horizontally extending handle 18. The handle 18 can be provided with finger grip indentations 18*a* to make the handle easier to hold and is attached to the shaft 14 by means of dowel pins 19. The upright shaft 20 of the posterior cane 14 has a guide comprising a pair of aligned laterally spaced apart forwardly projecting, parallel guide plates 22 and 24 which when the cane system is assembled as shown in FIG. 2 receive the anterior cane 12 between them. Extending between the rearward edges of the guide plates 22, 24 is a rear plate 26 which can either be secured to the plates 22, 24 or integral with them. Plates 22-26 comprise the shaft 20 of the rearward cane 14. Extending upwardly from the upper end of the plate 26 is a projection in the form of a tab 28. At the lower end of the shaft 20 of the rearward cane 14 is a bottom wall 30 and between the plates 22 and 24 is a lip 32 which forms a forward edge of an enclosure that defines an upwardly opening cup 34 for holding the lower end 36 of the forward cane 12 when in the stowed position as shown in FIG. 2. Placement of the lower end 36 of the anterior cane 12 in the cup 34 acts as a passive coupling. Projecting downwardly from the bottom wall 30 is a cane tip 40 that can be provided with a rubber cap or snubber 42 which makes contact with the ground. The lower end 36 of cane 12 can also be provided with a tip such as rubber cap 36*a*.

At the upper end of the elongated shaft of the forward cane 12 is provided a handle of any suitable shape but preferably comprises a ball-shaped handle 44 or if desired a rearwardly extending horizontally disposed pistol grip style handle similar to 18 (not shown). The handle 44 is of a suitable size to fit comfortably in the hand when the canes are separated as separated in FIG. 1 for use in each hand.

As can be seen in FIG. 2 the ball-shaped handle 44 at the top of the anterior cane shaft 13 is provided an upwardly extending downwardly opening circular recess 46 around the shaft 13 that is constructed and arranged to receive the tab 28 to provide a coupling 47 for connecting the anterior and posterior canes at their upper ends 16 and 17. When the anterior cane 12 is placed between the guide plates 22 and 24 during use and slid downwardly its lower end 36 will enter into the cup 34 which holds it in place while the cane system is used as a single cane as shown in FIG. 2. It will be noted that the plates 22, 24 perform an important function in enabling the forward cane to be stowed easily with little effort on the part of the user by guiding the lower end of the cane directly into the cup 34 as the forward cane is being lowered. If used separately, the canes can be disconnected by manually moving the anterior cane handle 44 apart from the posterior cane handle 18 by lifting it slightly so that the upper coupling 47 is disconnected and the shaft of the anterior cane is free to move out of the guide formed by plates 22, 24 and 26 so that the canes are thereby separately while in substantially horizontal alignment with one another. The coupling 47 can be separated by lifting the anterior cane typically from about ¼ inch to about 1 or 2 inches thereby keeping the canes substantial horizontal alignment as the anterior cane is moved laterally for independent use.

Figure 4:
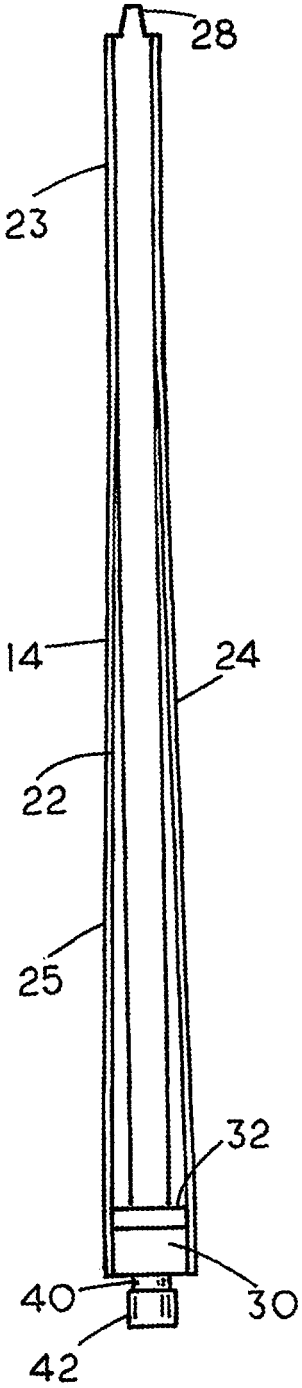
FIG. 4 is an end elevational view of the left-hand cane of FIG. 1 on a slightly reduced scale.
Figure 5:
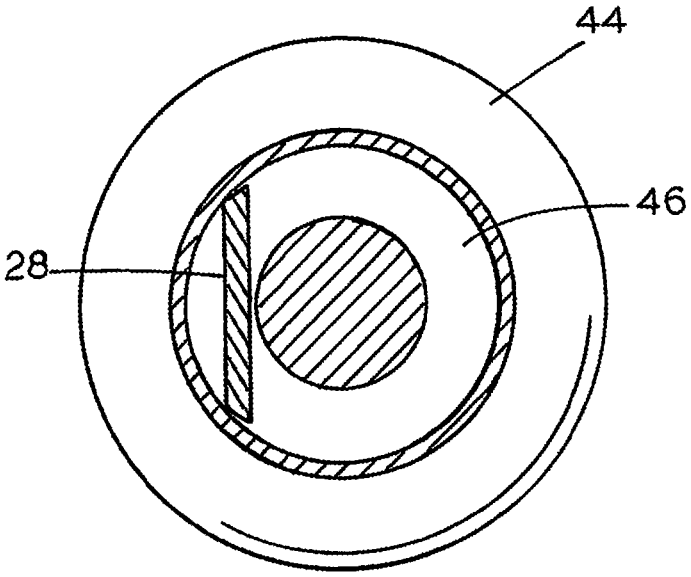
FIG. 5 is a horizontal cross-sectional view taken on line 5-5 of FIG. 2 on a larger scale.
Figure 6:
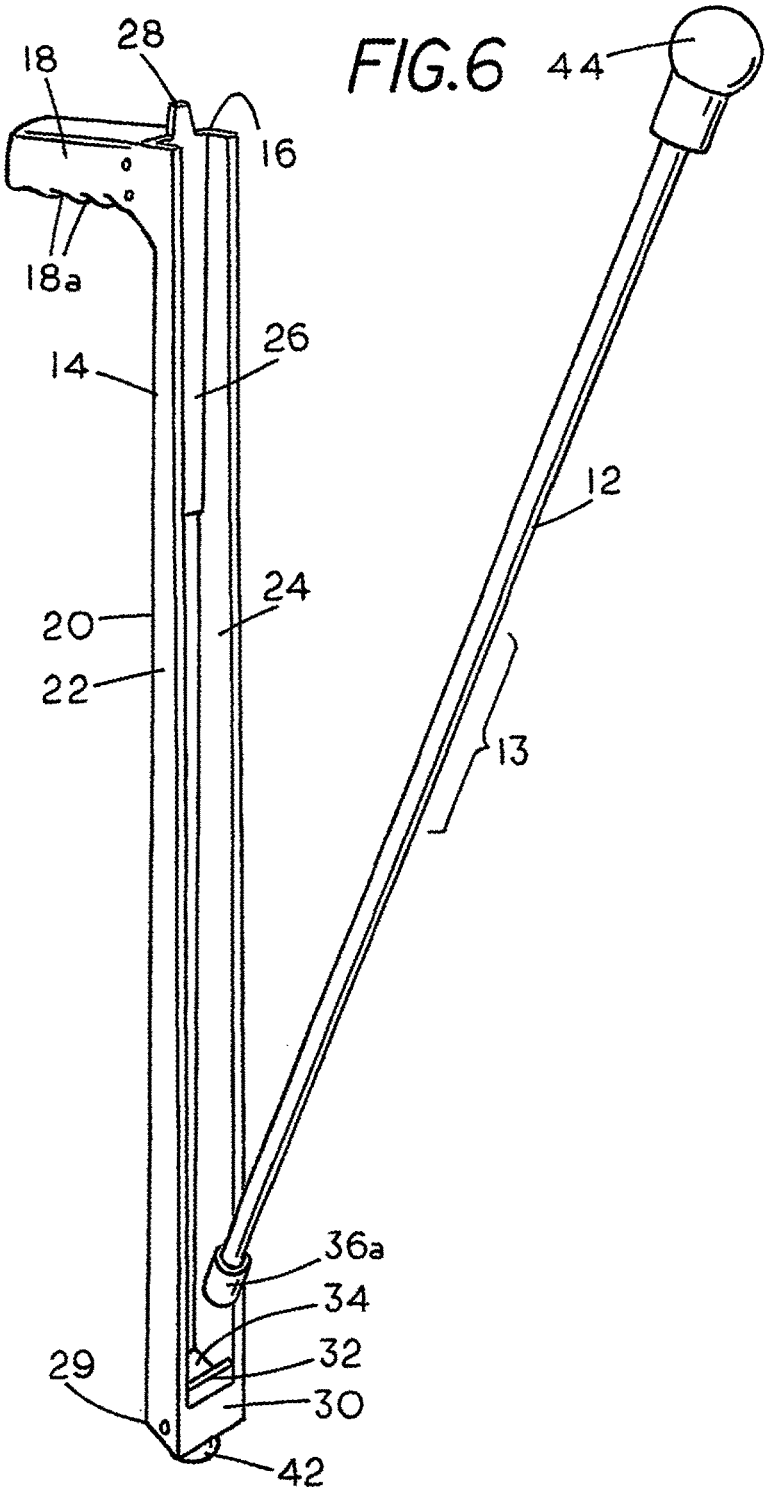
FIG. 6 is a perspective view similar to FIG. 1 showing the anterior cane at the right as it is being guided into place for attachment to the posterior cane for use with only one hand.
Figure 7:
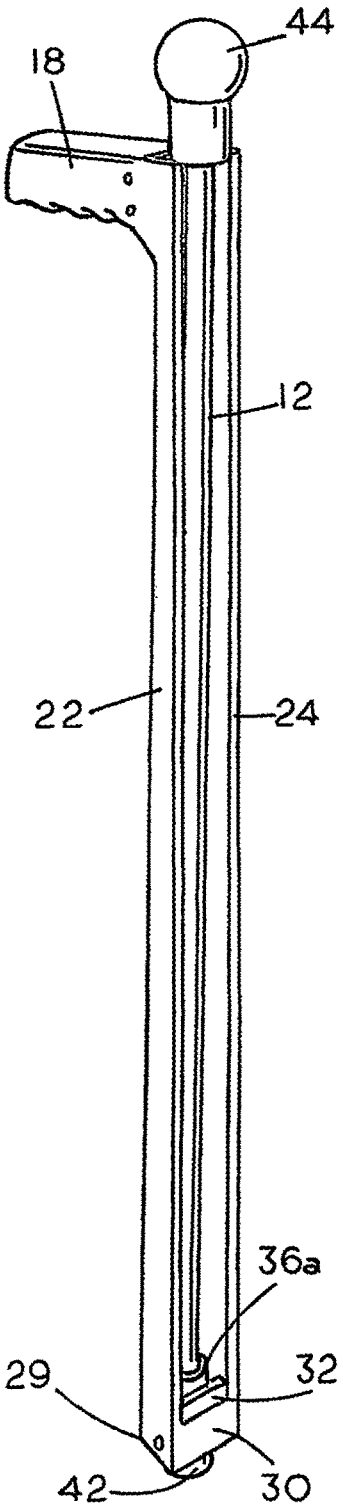
FIG. 7 is a perspective view of the assembled cane system ready for use with one hand.

FIG. 4 shows how the guide plates 22 and 24 of the posterior cane 14 can be closer together at their upper ends 23 than at their lower ends 25 for the purpose of simplifying the placement of the anterior cane 12 into the cup 34, then as the handle 44 is brought into alignment with the tab 28 of the coupling 47 the narrow segment 23 holds the upper end of the anterior cane in more precise alignment with the tab 28. The cane shown in FIGS. 1-7 can be formed from any suitable material such as wood or lightweight metal such as aluminum. The shafts 12 and 14 or 56 and 58 (FIG. 8) of each cane if made of aluminum can be formed from tubing. It can be seen that the anterior and posterior canes are somewhat different in form and function allowing the canes to both have exactly the same length. As noted above, the posterior cane acts as a receiver for stowing the anterior cane so that together they can be used as a single cane by gripping the handle 18. Unitization of the two canes is accomplished by the mechanical coupling 47 which is secured entirely by gravity and without the use of hooks, pins, latches, bands, snap fits or buttons that need to be manipulated by the user.

FIG. 2 shows how two walking canes are configured so that one can be stowed in alignment with the other and secured entirely by gravity. The stowage and retrieval are both easy and quick while using a natural movement of the hand and wrist. Moreover, transitioning between modes can be made while walking without being noticed by casual observers. This ease of transitioning is the basis for the friendly nature of the invention. A typical application is to approach a doorway while in the dual mode, transition to the single mode to pass through the doorway then transition back to dual mode.

In order for the center line of the anterior cane to meet a center point of the bottom wall 30, it is preferred that the center line of the shaft 13 be positioned rearwardly of the center line of shaft 14 by an angle D as shown in FIG. 2. Typically, this angle varies between 1.5 and 2.0 degrees. The corresponding reduction in what would be a right angle between the handle 18 and the shaft 20 enhances the walking stability by bringing the force on the ground via the snubber 42 more in line with the force on the pistol grip 18. The ergonomic advantage of quick and easy stowage and retrieval of the anterior cane avoids the clumsiness or awkwardness which would otherwise become an embarrassment to the user. This ergonomic efficiency and comfort in operation in combination with good visual appeal is assisted by the use of a ball grip for the anterior cane and a pistol grip for the posterior cane. The ball grip is also superior for distributing a load over the palm of the hand. The pistol grip is also superior to a shepherd hood or camel shape for manipulating the posterior cane as a receiver. The anterior cane can be quickly retrieved from storage by simply pulling upwardly and slightly forward on the handle 44. The stowed position (FIGS. 2 and 7) is easily achieved by manually and effortlessly maneuvering the cane through a single smooth movement beginning by placing the lower end of the anterior cane into the trough between guides 22 and 24 and against the back panel 26 a couple of inches above the bottom wall 30. Next the user swings the hand to bring the entire staff of the anterior cane into the trough and finally pushing the cane downwardly into the stowed position of in FIG. 2 which shows how the lower end of the anterior cane is in enclosed within the cup and the top coupling 47 is fully engaged. The grip on the ball handle 44 may now be released because its position will be secured by gravity acting on the mass of the anterior cane.

When in stowed position the two canes 12 and 14 together can be used as a single cane by either hand so that one hand is freed up to perform other tasks. The anterior cane can be easily retrieved while continuing to walk by lifting the handle 44 upwardly a small distance, e.g., from ¼ inch to an inch or two and slightly forwardly with the canes in substantial horizontal alignment. This movement is so natural that it can be accomplished using the ball handle 44 without eye contact. With some practice, stowage of the anterior cane can be accomplished while walking.

Figure 9:
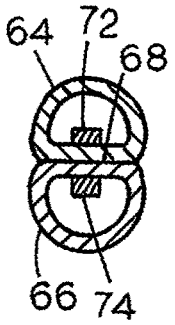
FIG. 9 is a vertical cross-sectional view taken on line 9-9 of FIG. 8.
Figure 8:
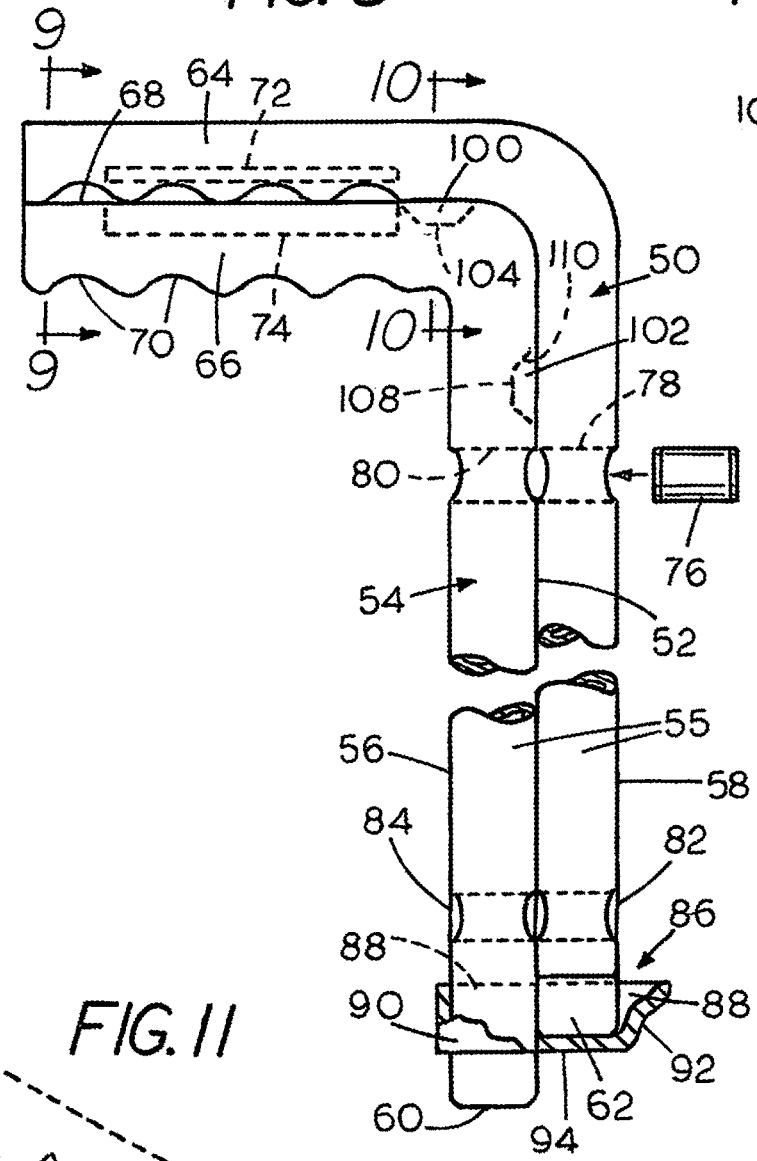
FIG. 8 is a side elevational view partly in section of another form of the invention as seen when assembled for use in one hand.

Refer now to FIGS. 8-12 which show another embodiment of the invention that can be made for the most part from metal such as aluminum tubing. The cane system of FIGS. 8-12 has an anterior cane 50 that when assembled comes into contact along a vertical line 52 with the posterior cane 54. The canes have vertical shafts 56 and 58. The bottom end of the canes have suitable high friction non-slip surface provided, for example, by rubber caps 60 and 62. A rearwardly extending handle is provided at the upper end of each cane. The handle can be integral with the shafts as shown or separate pieces (not shown) attached by fasteners or by welding. It will be seen that the handle 64 of the anterior cane lies in contact with the upper surface of the posterior cane handle 66 along a line 68. Each cane can, if desired, be provided with finger grip indentations 70. In cross-section the handles can be round or if desired flattened along line 68 if desired as best seen in FIG. 9 for providing a dual handle that is comfortable and easy to grasp with one hand while the canes are assembled to function as a single cane as seen in FIGS. 8 and 9. Inside the tubular handles are secured parallel magnets 72 and 74 to hold handles in alignment with one another and to assist in bringing the canes into the stowed position shown in FIGS. 8-10.

Cylindrical magnets such as magnet 76 can also be mounted in bore holes such as 78 and 80 in the position shown to bring the anterior and posterior canes into the aligned position of FIG. 8 near the upper end of the cane assembly. A second pair of alignment magnets 82 and 84 are also provided for assisting and maintaining in the alignment of the lower ends of the canes. It will be seen in FIG. 8 that at least one magnet is secured to one of the handles in a cooperative relationship with the other handle for drawing the handles into aligned contact and at least one magnet is also secured to each of the shafts in cooperative relationship for simultaneously drawing the shafts into aligned contact with one another. If desired one magnet of each pair shown in FIGS. 8, 9 and 11 can be replaced by a suitable ferromagnetic material such as iron.

Figure 12:
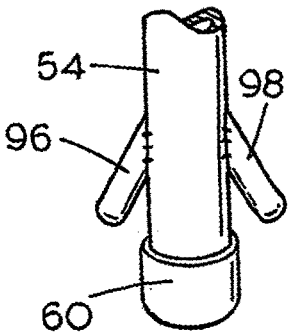
FIG. 12 is a partial perspective view of the lower end of the posterior cane of FIGS. 8-11 with a modified form of guide at the lower end of the posterior cane shaft for holding the anterior cane.

At the lower ends of the posterior cane shaft is provided a guide indicated generally by the numeral 86 which includes a pair of vertically disposed laterally spaced apart forwardly extending guide plates 88 and 90 only parts of which are shown that is secured as by welding to the posterior cane 54 to extend forwardly for receiving between them the lower end of the anterior cane 50. Extending between the forward ends of the guide plates 88 and 90 is provided an anterior wall 92 and between their lower edges a bottom wall 94 which together form an upwardly opening cup that serves as a coupling which cooperate with the magnets 82 and 84 to releasably hold the lower ends of the canes in alignment with one another while the anterior cane 50 is in the stowed position of FIG. 8. The alignment guide is not limited to the form shown in FIG. 8 but as seen in the embodiment of FIG. 12 comprises a pair of laterally spaced apart forwardly extending guide members 96 and 98 secured to the rearward cane 54 as by welding that together serve as a guide for first locating and then retaining the lower end of the anterior cane in the aligned position just ahead of the posterior cane 56.

Figure 10:
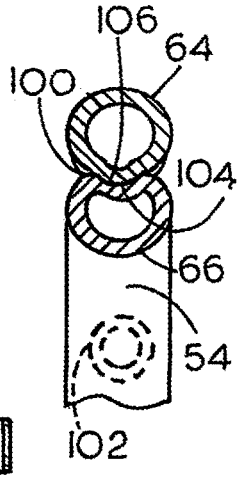
FIG. 10 is a vertical cross-sectional view taken on line 10-10 of FIG. 8.
Figure 11:
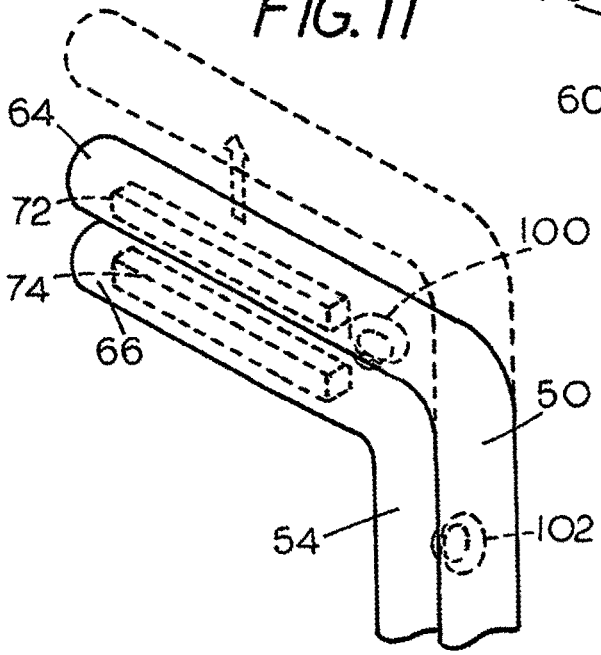
FIG. 11 is a partial perspective view of the embodiment of FIGS. 8-10 to show the anterior cane being separated from the posterior cane.

As in FIGS. 1-7, a coupling is provided between the upper ends of the canes to assist in securing them together when assembled as shown in FIGS. 8, 10 and 11. In this case a pair of similar couplings 100 and 102 are provided. The upper coupling 100 is formed from a downwardly extending tapered projection 104 which during use mates with an upwardly opening similarly shaped tapered recess 106 (FIG. 10). Both the recess and the projection can be frustoconical or simply rounded or parabolic in cross section, but a tapered configuration is preferred which makes the couplings self-aligning. As in the coupling 100, the coupling 102 has a tapered projection 108 that extends into a tapered pocket 110 of the same shape as 108 to provide a self-aligning coupling to hold the canes together as shown in FIG. 8.

FIG. 11 shows how the anterior cane 50 can be separated from the posterior cane 54 only a short distance, for example, less than half an inch thereby disconnecting both of the couplings 100 and 102 from one another while the canes remain substantially in horizontal alignment with one another so that the anterior cane 50 does not need to be lifted a long distance above the posterior cane 54 since they are easily separated from one another when they are less than half an inch apart. When the anterior cane is to be stowed, the lower end of the anterior cane can be placed between the guide plates 88 and 90 (FIG. 8) or between the guide projections 96 and 98 (FIG. 12) and the anterior cane handle 64 then placed on top of the handle 66 at which point the magnets 72, 74 and 76 in cooperation with the self-aligning couplings 100 and 102 will easily bring the anterior cane into the stowed position shown in FIGS. 8-10 so that the duplex cane system can function either as a single cane for one hand or as two separate canes for independent use in each hand in a convenient and user-friendly way thereby avoiding the awkwardness, clumsiness and embarrassment associated with prior dual cane systems.

This invention has been described herein in considerable detail in order to comply with the patent statutes and to provide those skilled in the art with the information needed to apply the novel principles and to construct and use such specialized components as are required. However, it is to be understood that the invention can be carried out by specifically different equipment and devices, and that various modifications, both as to the equipment and operating procedures, can be accomplished without departing from the scope of the invention itself.

The invention claimed is:

1. A walking cane system comprising a pair of canes adapted to be used separately or releasably associated for use in one hand, the cane system comprising, an anterior cane and a posterior cane each with an elongated shaft having upper and lower ends with a middle part therebetween and a handle at the upper end of each shaft, an upper coupling constructed to align the canes with one another and enable the canes to move axially relative to one another, the coupling being located at or above the middle part of the cane system, a guide on one of the canes comprising a pair of spaced apart guide members extending from one cane shaft toward the other cane shaft and when the cane system is assembled, the guide receives the other cane shaft between the spaced apart guide members during use when at least a part of the other cane shaft is placed in the guide between the members whereby a guide member is on either side thereof such that the anterior and posterior canes are held by the guide members when brought toward one another to approach or achieve an aligned relationship, the canes being constructed and arranged for being disengaged by manually moving the anterior cane handle upwardly and away from the posterior cane handle so that the upper coupling is disengaged and the shaft of the other cane is free to move out of the guide such that the anterior and posterior canes are thereby separated while in substantial horizontal alignment with one another whereby one of the canes can then be held in each hand of the user in position ready to be used, thereby providing a user-friendly walking cane system.

2. The cane system of claim 1 wherein the upper coupling comprises a recess in one cane and a projection on the other cane that extends substantially parallel to the shaft of the other cane in a position that is able to enter the recess when the cane shafts are parallel to one another and one shaft is then moved axially so as to thereby locate the canes relative to one another with the anterior cane ahead of the posterior cane.

3. The cane system of claim 1 wherein the guide members comprise a pair of spaced apart opposed panels extending axially along the shaft of the posterior cane to form a trough in which the panels serve as guide rails for the anterior cane by receiving the anterior cane therebetween when the canes are brought together by the user.

4. The cane system of claim 1 wherein the guide members extend forwardly from the posterior cane and are spaced apart from one another sufficiently to hold the anterior cane therebetween at a location on the posterior cane below the upper coupling.

5. A walking cane system comprising a pair of canes adapted to be used separately or releasably associated for use in one hand, the cane system comprising, an anterior cane and a posterior cane each with an elongated shaft having upper and lower ends with a middle part therebetween and a handle at the upper end of each shaft, an upper coupling to secure the canes together that is located at or above the middle part of the cane system, a guide on one of the canes comprising a pair of spaced apart guide members extending from one cane shaft toward the other cane shaft when the cane system is assembled, the guide being adapted to receive the other cane shaft during use by placing at least a part of the other cane shaft in the guide between the members such that the anterior and posterior canes can be brought toward one another to approach or achieve an aligned relationship, the canes being constructed and arranged for being disconnected by manually moving the anterior cane handle apart from the posterior cane handle so that the upper coupling is disconnected and the shaft of the other cane is free to move out of the guide such that the anterior and posterior canes are thereby separated while in substantial horizontal alignment with one another whereby the canes can then be held separately in each hand of the user in position to be used, thereby providing a user-friendly walking cane system and having an upwardly opening cup on one cane located below the middle part thereof to receive the lower end of the other cane.

6. A walking cane system comprising a pair of canes adapted to be used separately or releasably assembled for use in one hand, the cane system comprising a first cane and a second cane each having an elongated shaft with upper and lower ends and a handle at the upper end of each shaft, the canes having a coupling therebetween comprising a recess in one cane and an axially extending projection on the other cane adapted to enter the recess when the canes are moved axially into engagement with one another to join the canes together by a separable conjunct interface between the projection and the recess that is secured by gravitational weight of one of the canes and including an upwardly opening cup on one of the canes below a center part thereof to receive the lower end of the other cane when the other cane is in a stowed position.

7. A walking cane system comprising a pair of canes adapted to be used separately and while positioned together for use in one hand, the cane system comprising a first cane and a second cane each having an elongated shaft with an upper end, a middle lower end and a handle at the upper end of each shaft, the canes having a coupling therebetween located above the middle of the canes that locates the cane in close proximity with one another, a guide on one of the canes comprising a pair of spaced apart guide members extending from one cane shaft toward the other cane shaft when the cane system is assembled, the guide being located to receive the other cane shaft therebetween during use by placing at least a part of the other cane shaft in the guide between the guide members located on opposite sides thereof such that the first and second canes can be brought manually toward one another to approach or achieve an aligned relationship, the canes being constructed and arranged free from a mechanical latch between one another to thereby enable the canes to separate when the handles are moved apart from one another so that the shaft of the other cane is thereby free to move out of the guide, an upwardly facing support surface on one of the canes in a position to hold the other cane shaft in substantial horizontal alignment with said one cane such that the canes separate while in substantial horizontal alignment with one another whereby one such cane will then be held in each hand while in position ready for use thereby providing a user-friendly walking cane system.

8. The cane system of claim 7 wherein the coupling comprises a tapered pocket in one cane and a tapered projection on the other cane with a central axis that extends substantially parallel to the shaft of the other cane in a position that is able to enter the tapered pocket when the cane shafts are parallel to one another and one shaft is then moved axially so as to thereby locate the canes relative to one another.

9. The combined walking cane system of claim 7 wherein the first cane is a rearward cane having an elongated pistol grip handle and the second cane is a forward cane positioned ahead of the rearward cane having a ball handle.

10. The cane system of claim 7 including at least one magnet attached to each one of the canes in end-to-end axial alignment abutting one another when the canes are placed together to draw the shafts of the canes toward one another.

11. A walking cane system comprising a pair of canes adapted to be used separately and while positioned together for use in one hand, the cane system comprising a first cane and a second cane each having an elongated shaft with an upper end, a middle lower end and a handle at the upper end of each shaft, the canes having a coupling therebetween located above the middle of the canes that joins the canes together releasably, a guide on one of the canes comprising a pair of spaced apart guide members extending from one cane shaft toward the other cane shaft when the cane system is assembled, the guide being located to receive the other cane shaft during use by placing at least a part of the other cane shaft in the guide between the members such that the first and second canes can be brought toward one another to approach or achieve an aligned relationship, the canes being constructed and arranged for being disconnected by manually moving the handles apart from one another so that the coupling is disconnected and the shaft of the other cane is free to move out of the guide, an upwardly facing support surface on one of the canes in a position to hold the other cane shaft in substantial horizontal alignment with said one cane such that the canes are thereby separable while in substantial horizontal alignment with one another whereby one of the canes can be then be held in each hand in position for use thereby providing a user-friendly walking cane system having an upwardly opening cup on one cane located below the middle part thereof to receive the lower end of the other cane.

* * * * *